US009593396B2

(12) United States Patent
Luo et al.

(10) Patent No.: US 9,593,396 B2
(45) Date of Patent: Mar. 14, 2017

(54) HIGH STRENGTH/DUCTILITY MAGNESIUM-BASED ALLOYS FOR STRUCTURAL APPLICATIONS

(75) Inventors: Aihua A. Luo, Troy, MI (US); Anil K. Sachdev, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1818 days.

(21) Appl. No.: 11/749,201

(22) Filed: May 16, 2007

(65) Prior Publication Data

US 2007/0269337 A1 Nov. 22, 2007

Related U.S. Application Data

(60) Provisional application No. 60/801,632, filed on May 18, 2006.

(51) Int. Cl.
*C22C 23/02* (2006.01)

(52) U.S. Cl.
CPC ..... *C22C 23/02* (2013.01)

(58) Field of Classification Search
CPC ..... C22C 23/02; C22C 23/04
USPC ..... 148/420; 420/410
See application file for complete search history.

(56) References Cited

U.S. PATENT DOCUMENTS

| | | | | |
|---|---|---|---|---|
| 2,000,115 | A | 5/1935 | Wood | |
| 4,332,864 | A * | 6/1982 | King et al. | 429/3 |
| 6,264,763 | B1 * | 7/2001 | Powell et al. | 148/420 |
| 2003/0084968 | A1 | 5/2003 | Bronfin | |
| 2004/0154703 | A1 | 8/2004 | Nakamura et al. | |

FOREIGN PATENT DOCUMENTS

| | | |
|---|---|---|
| CN | 1515696 | 7/2004 |
| DE | 30 34 938 A1 | 4/1981 |

OTHER PUBLICATIONS

PCT International Search Report mailed May 6, 2008.

* cited by examiner

*Primary Examiner* — Weiping Zhu
(74) *Attorney, Agent, or Firm* — BrooksGroup

(57) ABSTRACT

A tin-containing magnesium-aluminum-manganese (Mg—Al—Mn) based alloy that provides a desired combination of strength and ductility so as to be particularly suited for structural applications. The alloy includes magnesium, aluminum, and manganese in combination and about 0.5% to about 3.5% tin. The tin addition improves strength without substantial loss of ductility.

18 Claims, 3 Drawing Sheets

*Effect of Sn content on the tensile properties of AM70 alloy.*

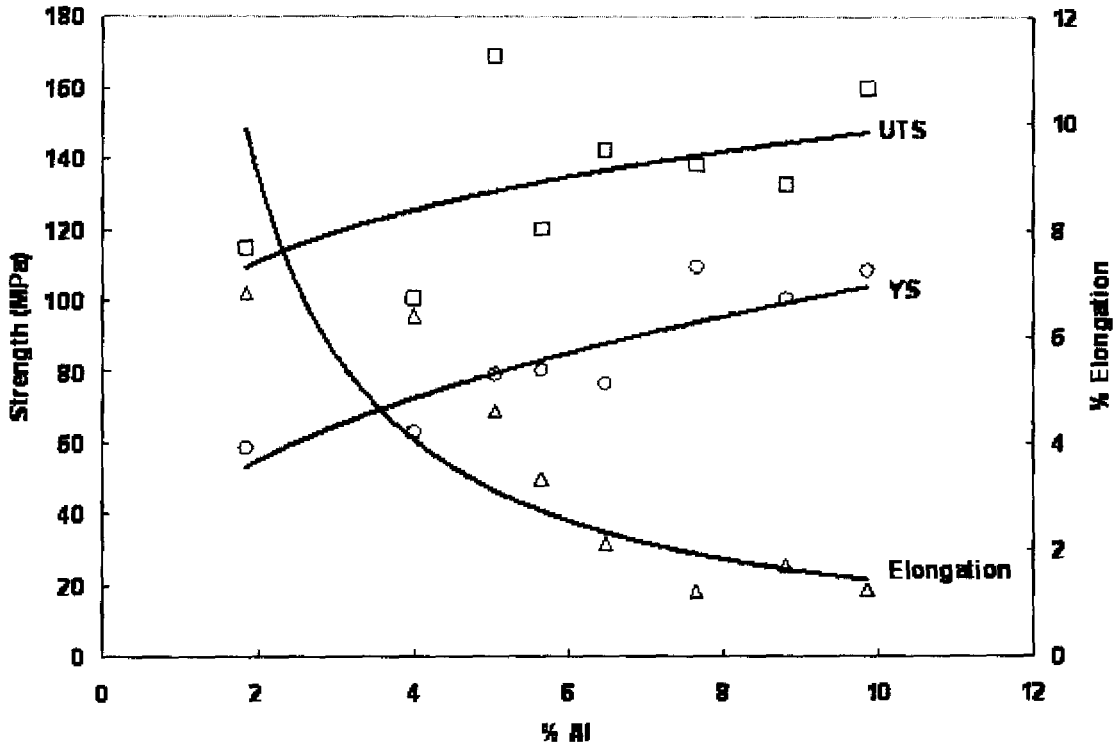
*Fig. 1. Tensile properties of Mg-Al-Mn alloys in as-cast condition.*

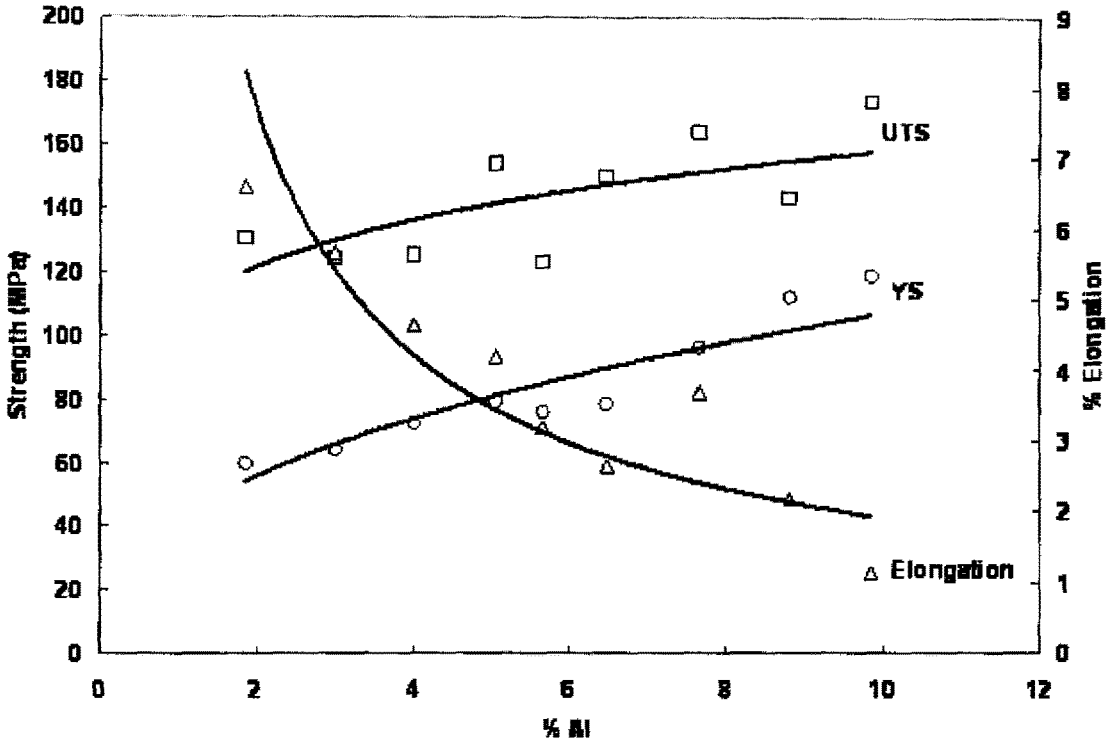
*Fig. 2. Tensile properties of Mg-Al-Mn alloys in T5 condition (5 hours @ 232°C).*

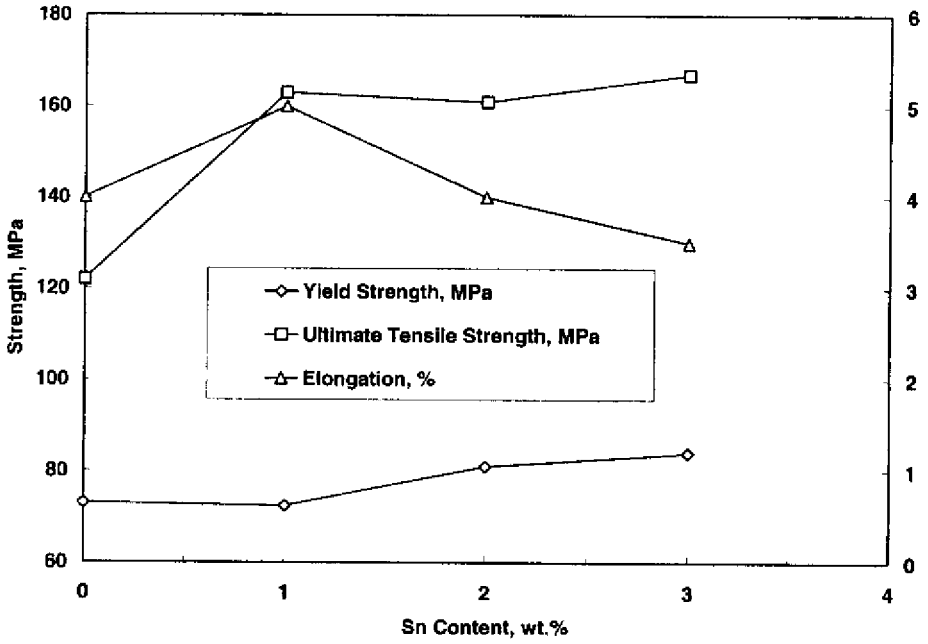
*Fig. 3. Effect of Sn content on the tensile properties of AM70 alloy.*

HIGH STRENGTH/DUCTILITY MAGNESIUM-BASED ALLOYS FOR STRUCTURAL APPLICATIONS

CROSS-REFERENCE TO RELATED APPLICATIONS

This application claims the benefit of and priority from U.S. Provisional Application 60/801,632 filed May 18, 2006 the contents of which are hereby incorporated by reference in their entirety

TECHNICAL FIELD

The present invention relates generally to the field of structural alloys and more particularly to a tin-containing magnesium-aluminum-manganese (Mg—Al—Mn) based alloy. The alloy composition provides a desirable combination of strength and ductility.

BACKGROUND OF THE INVENTION

There are currently two major alloy systems, Mg—Al—Zn (AZ) and Mg—Al—Mn (AM), for automotive casting applications. AZ91 (Mg-9% Al-1% Zn) is used in many non-structural and low-temperature components where strength is desired, such as brackets, covers, cases and housings; providing essentially the same functionality with significant mass savings compared to steel, cast iron or aluminum alloys. For structural applications such as instrument panel beams, steering systems and radiator support, where crashworthiness is important, AM50 (Mg-5% Al-0.3% Mn) or AM60 (Mg-6% Al-0.3% Mn), offer unique advantages due to their higher ductility (10-15% elongation) and higher impact strength compared to die cast magnesium alloy AZ91 or aluminum alloy A380, but at the expense of strength.

SUMMARY OF THE INVENTION

The present invention provides advantages and alternatives over the prior art by providing a tin-containing magnesium-aluminum-manganese (Mg—Al—Mn) based alloy that provides a desired combination of strength and ductility so as to be particularly suited for structural applications.

BRIEF DESCRIPTION OF THE DRAWINGS

The present invention will now be described by way of example only, with reference to the accompanying drawings which constitute a part of the specification herein and, together with the general description above and the detailed description set forth below serve to explain concepts of the invention wherein:

FIGS. 1 and 2 illustrate respectively the effect of aluminum content on the tensile properties of Mg—Al—Mn alloys in as-cast condition and after heat treatment for 5 hours @ 232° C.; and FIG. 3 illustrates the effect of Sn additions on the tensile properties of an Mg—Al—Mn alloy While embodiments and practices according to the invention have been illustrated and generally described above and will hereinafter be described in connection with certain potentially preferred procedures and practices, it is to be understood that in no event is the invention to be limited to such illustrated and described embodiments procedures and practices. On the contrary, it is intended that the present invention shall extend to all alternatives and modifications as may embrace the principles of this invention within the true spirit and scope thereof.

DESCRIPTION OF PREFERRED EMBODIMENTS

Referring now to the drawings, FIG. 1 illustrates the effect of aluminum content on the tensile properties of Mg—Al—Mn alloys in as-cast condition. FIG. 2 illustrates the effect of aluminum content on the tensile properties of Mg—Al—Mn alloys after heat treatment for 5 hours @ 232° C. As shown, ultimate tensile strength (UTS) and yield strength increase with Al content while elongation (i.e. ductility) decreases. It is contemplated that an addition of about 6.5-9% Al should provide a good balance of strength and ductility for structural applications.

In order to evaluate the effect of Sn addition on strength and ductility, a base Mg—Al—Mn alloy was utilized with progressively increasing levels of Sn addition. Specifically, the base alloy was AM70 having a composition as set forth in the following table

| Alloy* | Al | Mn | Zn | Si | Cu | Fe | Ni |
|---|---|---|---|---|---|---|---|
| AM70 | 6.8 | 0.21 | 0.03 | <0.05 | <0.003 | <0.005 | <0.003 |

The results of Sn addition to this alloy are set forth in FIG. 3. It was shown that 1-3% Sn addition increases the yield strength (11-15%) and ultimate tensile strength (32-37%) without much loss in ductility. A contemplated desired range for Sn additions to achieve beneficial results of increased strength without substantial loss of ductility is about 0.5 to about 3.5%. Based on these results, it is contemplated that an Mg—Al—Mn alloy with the following composition may provide desirable performance benefits.

Mg: Balance
Al: about 6.5-about 9% (preferably about 6.8-about 9%)
Sn: about 0.5-about 3.5% (preferably about 0.9-about 3%)
Mn: about 0.25-about 0.6%
Zn: 0.22% maximum
Si: 0.01% maximum
Cu: 0.01% maximum
Ni: 0.002% maximum
Fe: 0.002% maximum
Others: 0.02% maximum

Examples

By way of example only, and not limitation, the invention may be further understood through reference to the following non-limiting exemplary alloy compositions as set forth in Table 1 below.

TABLE 1

(weight %) of Mg—Al—Mn alloys with Sn alloying additions

| Alloy | Al | Mn | Sn | Fe | Cu | Ni |
|---|---|---|---|---|---|---|
| 1 | 6.9 | 0.26 | 0.9 | <0.003 | <0.003 | <0.003 |
| 2 | 6.9 | 0.25 | 1.9 | <0.003 | <0.003 | <0.003 |
| 3 | 6.8 | 0.27 | 3.0 | <0.003 | <0.003 | <0.003 |

Mg - Balance

It is to be understood that while the present invention has been illustrated and described in relation to potentially preferred embodiments, constructions, and procedures, that such embodiments, constructions, and procedures are illustrative only and that the present invention is in no event to be limited thereto. Rather, it is contemplated that modifications and variations embodying the principles of the present invention will no doubt occur to those of skill in the art.

What is claimed is:

1. An automotive structural casting consisting essentially of by weight, about 0.8% to about 1.5% tin, not less than 6.5% to about 9% aluminum, about 0.25% to about 0.6% manganese, up to about 0.22% zinc, with the balance being substantially all magnesium with trace amounts of silicon, copper, nickel, iron and other ordinarily present elements wherein the automotive structural casting is an instrument panel beam, a steering system support, or a radiator support.

2. The automotive structural casting of claim 1, wherein aluminum is present at a level of not less than about 6.8% to about 8%.

3. The automotive structural casting of claim 1, wherein aluminum is present at a level of about 8% to about 9%.

4. The automotive structural casting of claim 1, wherein aluminum is present at a level of not less than about 6.8% to about 8%.

5. The automotive structural casting of claim 1, wherein aluminum is present at a level of about 8% to about 9%.

6. The automotive structural casting of claim 1, wherein aluminum is present at a level of not less than about 6.8% to about 8%.

7. The automotive structural casting of claim 1, wherein aluminum is present at a level of about 8% to about 9%.

8. The automotive structural casting of claim 1, wherein casting is heat treated and has a yield strength of at least 160 MPa.

9. An automotive structural casting consisting essentially of by weight, about 0.8% to about 3.2% tin, not less than 6.5% to about 9% aluminum, about 0.25% to about 0.6% manganese, about 0.03% to about 0.22% zinc, up to about 0.01% silicon, up to about 0.01% copper, up to about 0.002% nickel, and up to about 0.002% iron, with the balance being substantially all magnesium with trace amounts of ordinarily present elements; wherein said trace amounts are no greater than about 0.02% wherein the automotive structural casting is an instrument panel beam, a steering system support, or a radiator support.

10. The automotive structural casting of claim 9, wherein tin is present at a level of about 0.8% to about 1.5%.

11. The automotive structural casting of claim 10, wherein aluminum is present at a level of not less than about 6.8% to about 8%.

12. The automotive structural casting of claim 10, wherein aluminum is present at a level of about 8% to about 9%.

13. The automotive structural casting of claim 9, wherein tin is present at a level of about 1.6% to about 2.5%.

14. The automotive structural casting of claim 13, wherein aluminum is present at a level of not less than about 6.8% to about 8%.

15. The automotive structural casting of claim 13, wherein aluminum is present at a level of about 8% to about 9%.

16. The automotive structural casting of claim 9, wherein tin is present at a level of about 2.6% to about 3.2%.

17. The automotive structural casting of claim 16, wherein aluminum is present at a level of not less than about 6.8% to about 8%.

18. The automotive structural casting of claim 16, wherein aluminum is present at a level of about 8% to about 9%.

* * * * *